US012007192B2

(12) United States Patent
Lewis

(10) Patent No.: US 12,007,192 B2
(45) Date of Patent: Jun. 11, 2024

(54) FIREARM TRAINING DEVICES AND METHODS OF USE

(71) Applicant: Rashon Q Lewis, Missouri City, TX (US)

(72) Inventor: Rashon Q Lewis, Missouri City, TX (US)

( * ) Notice: Subject to any disclaimer, the term of this patent is extended or adjusted under 35 U.S.C. 154(b) by 1234 days.

(21) Appl. No.: 16/543,498

(22) Filed: Aug. 16, 2019

(65) Prior Publication Data

US 2021/0048266 A1 Feb. 18, 2021

(51) Int. Cl.

| | |
|---|---|
| ***F41A 33/00*** | (2006.01) |
| ***F41C 27/00*** | (2006.01) |
| *A63B 21/00* | (2006.01) |
| *A63B 21/04* | (2006.01) |
| *A63B 21/055* | (2006.01) |

(52) U.S. Cl.

CPC ..... *F41A 33/00* (2013.01); *F41C 27/00* (2013.01); *A63B 21/0442* (2013.01); *A63B 21/0552* (2013.01); *A63B 21/4007* (2015.10); *A63B 21/4025* (2015.10); *A63B 21/4027* (2015.10); *A63B 21/4043* (2015.10)

(58) Field of Classification Search

CPC ..... F41A 33/00; F41C 27/00; F41C 33/001; A63B 21/0442; A63B 21/0552; A63B 21/4007; A63B 21/4025; A63B 21/4027; A63B 21/4043; A63B 21/4035

USPC ..... 434/16

See application file for complete search history.

(56) References Cited

U.S. PATENT DOCUMENTS

| | | | | |
|---|---|---|---|---|
| 8,801,583 | B1 * | 8/2014 | Shenkin | A63B 21/0555 482/133 |
| 2004/0083637 | A1 * | 5/2004 | Sands | F41C 33/001 42/85 |
| 2018/0142982 | A1 * | 5/2018 | Schwendemann | F41A 33/00 |

OTHER PUBLICATIONS

Muscle Mount: The World's First Firearm Functional Fitness System. musclemount.com, 2018 [retrieved on Jul. 29, 2022]. Retrieved from the Internet: <URL: https://web.archive.org/web/20180324104745/http://musclemount.com/>. (Year: 2018).*

(Continued)

*Primary Examiner* — Peter S Vasat
*Assistant Examiner* — Stephen Alvesteffer
(74) *Attorney, Agent, or Firm* — Quisenberry Law PLLC

(57) ABSTRACT

A firearm training device is disclosed that may include a body member having a grip. The barrel section may include a muzzle end and a rear or butt stock end. The barrel section may include a transverse aperture adjacent one of the rear/butt stock end. The firearm training device may include a stretchable loop exercise band disposed through the transverse aperture and connected to the body member. The body member may be in a variety of shapes, such as a hand gun or a rifle. The stretchable loop exercise band is adapted for being wrapped around a person's torso so it can be used to perform exercises to strengthen the person's ability to grip a firearm.

7 Claims, 5 Drawing Sheets

(56) References Cited

OTHER PUBLICATIONS

Screen captures from YouTube video clip entitled "Training with the Muscle Mount and SIRT pistol," 2 pages, uploaded on Mar. 24, 2015 by user "Stew Smith". Retrieved from Internet: <https://www.youtube.com/watch?v=G_skDh1IPVw>. (Year: 2015).*

Bionic Body Workout Bar. amazon.com, first available for sale Sep. 19, 2014 [retrieved on Jul. 29, 2022]. Retrieved from the Internet: <URL: https://www.amazon.com/Bionic-Body-Strength-Training-Exercise/dp/B00NPZ7G36>. (Year: 2014).*

* cited by examiner

FIREARM TRAINING DEVICES AND METHODS OF USE

BACKGROUND OF THE INVENTIONS

1. Field of the Inventions

The present inventions generally pertain to the field of firearm training, and more particularly to firearm training devices and methods for strengthening a person's ability to grip and maintain control of a firearm.

2. Description of the Related Art

Various firearm training devices exist for various reasons, but firearm training devices and exercises that can be used to strengthen a person's ability to grip and maintain control of a firearm are not known. As such, there has developed a need for such training devices and related methods. As explained below, the present inventions solve this need in the art.

SUMMARY OF THE INVENTIONS

The present inventions generally relate, in one aspect, to a firearm training device comprising: a body member having a barrel section and a grip; the barrel section having a muzzle end and a rear end; the barrel section having a transverse aperture adjacent the rear end of the barrel section; and a stretchable loop member disposed through the transverse aperture and connected to the body member. Another feature of this aspect of the present inventions may be that the body member may be in the shape of a hand gun.

In another aspect, the present inventions may generally relate to a firearm training device comprising: a body member having a grip, a muzzle end and a butt stock end; the body member having a transverse aperture adjacent the muzzle end of the body member; and a stretchable loop member disposed through the transverse aperture and connected to the body member. Another feature of this aspect of the present inventions may be that the body member may be in the shape of a rifle.

In another aspect, the present inventions may generally relate to a method of performing an exercise to strengthen the ability of a person to grip a firearm comprising: using a firearm training device to perform an exercise, the firearm training device having a body member, a grip, and a stretchable loop exercise band connected to the body member; positioning the stretchable loop exercise band around a person's torso; the person gripping the grip of the firearm training device with at least one hand; and the person using the firearm training device to perform an exercise. Another feature of this aspect of the present inventions may be that the body member may be in the shape of one of a hand gun and a rifle. Another feature of this aspect of the present inventions may be that the person may move the firearm training device from a first position in which the person's arms are bent with elbows adjacent the person's torso and the stretchable loop exercise band is in a slack position, to a second position in which the person's arms are straight and held away from the person's torso with the stretchable loop exercise band in a stretched position.

Other features, aspects and advantages of the present inventions will become apparent from the following discussion and detailed description.

While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTION

Figure 1:
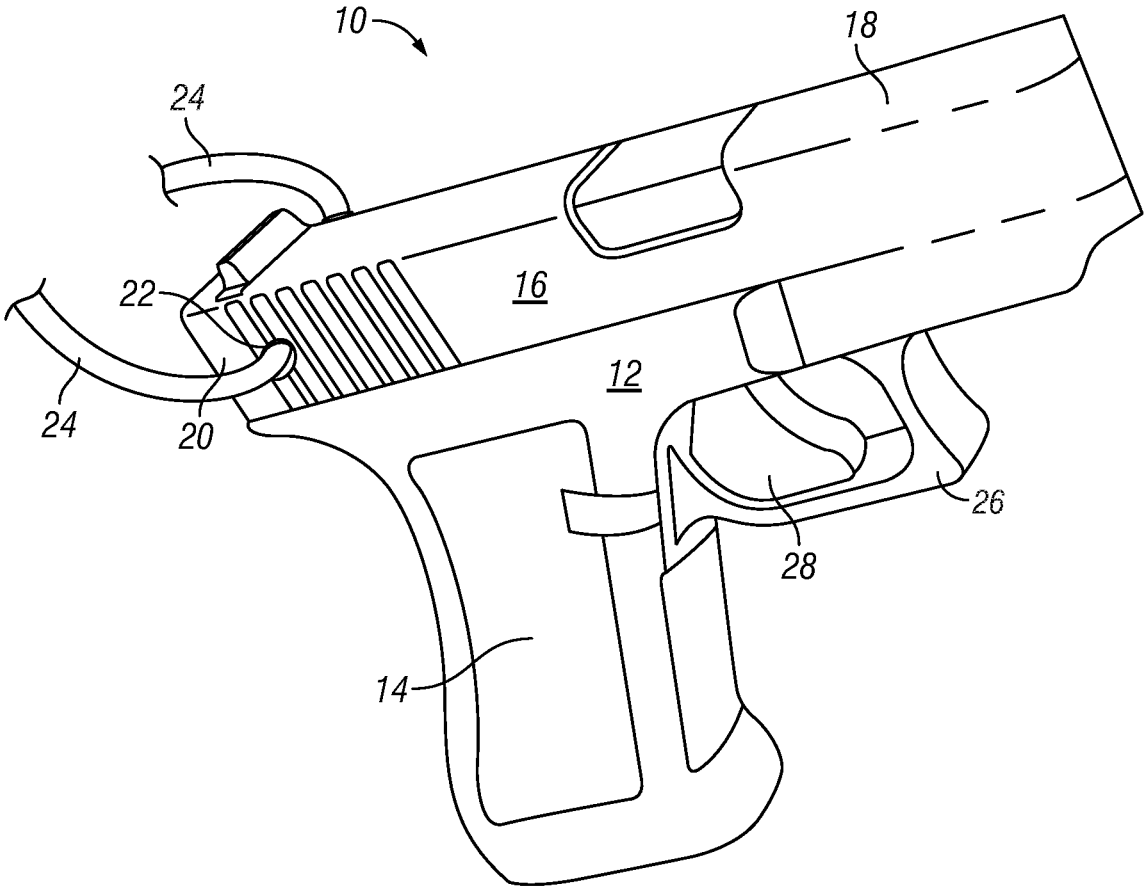
FIG. 1 is a perspective view showing a specific embodiment of a firearm training device in the form of a hand gun constructed in accordance with one aspect of the present inventions.
Figure 2:
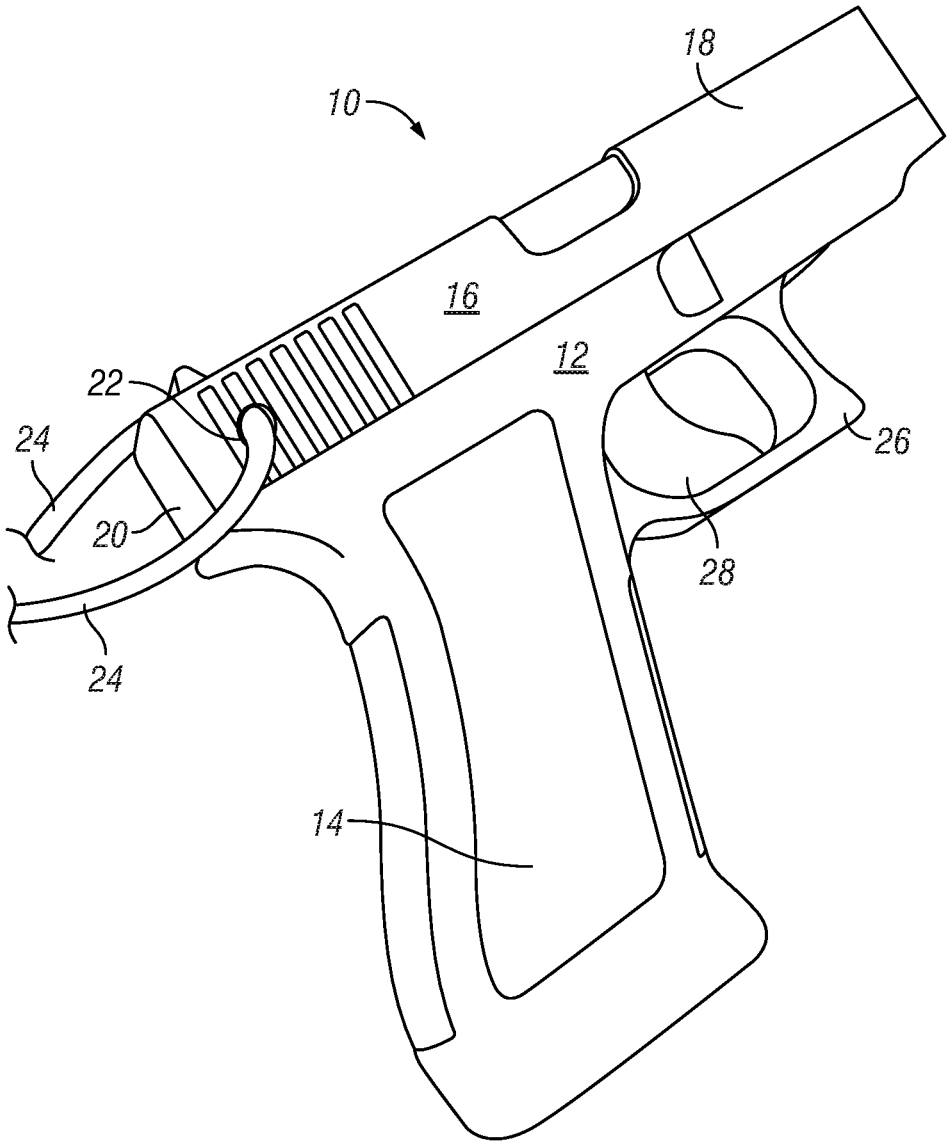
FIG. 2 is another perspective view showing a specific embodiment of a firearm training device in the form of a hand gun constructed in accordance with one aspect of the present inventions.

Referring to the drawings in detail, wherein like numerals denote identical elements throughout the several views, and referring initially to FIGS. 1 and 2, there is shown a specific embodiment of a firearm training device 10 in the form of a hand gun that may include a body member 12 having a grip or handle 14 and a barrel section 16. The barrel section 16 includes a muzzle end 18 and a rear end 20. In a specific embodiment, the barrel section 16 may include a transverse aperture 22 near the rear end 20. The firearm training device 10 may include a stretchable loop cord or exercise band 24 connected to the body member 12 through the transverse aperture 22. In a specific embodiment, the stretchable loop cord 24 may be a bungee cord. The body member 12 may further include a trigger guard 26 and a trigger 28.

Figure 3:
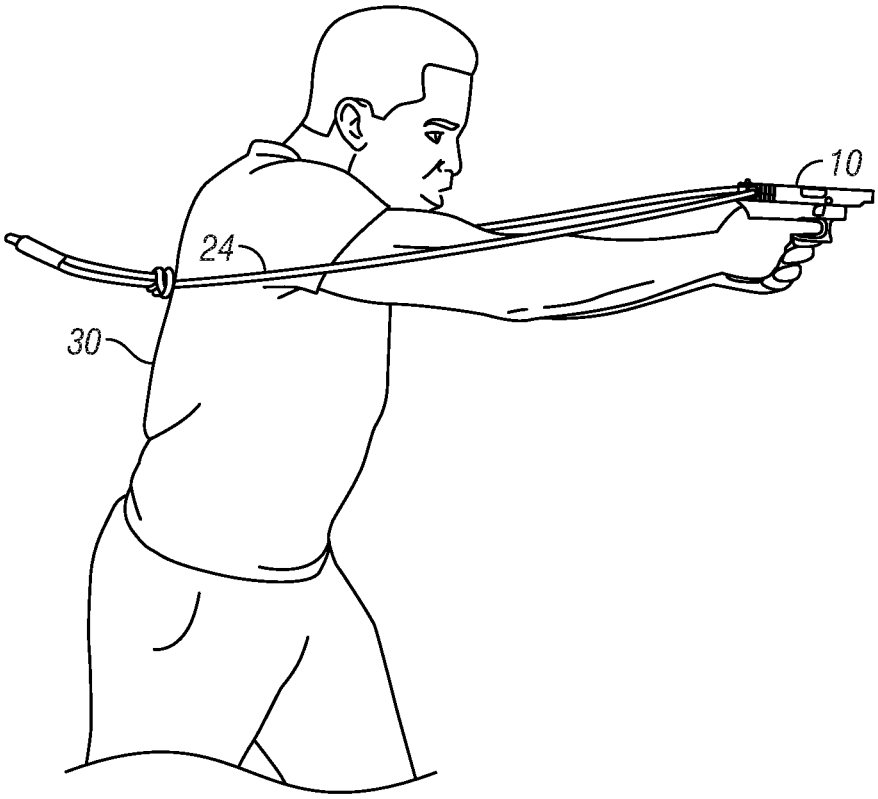
FIG. 3 is a side view of a person using a firearm training device in accordance with the present inventions to perform an exercise to strengthen the person's ability to grip and maintain control of a firearm.
Figure 4:
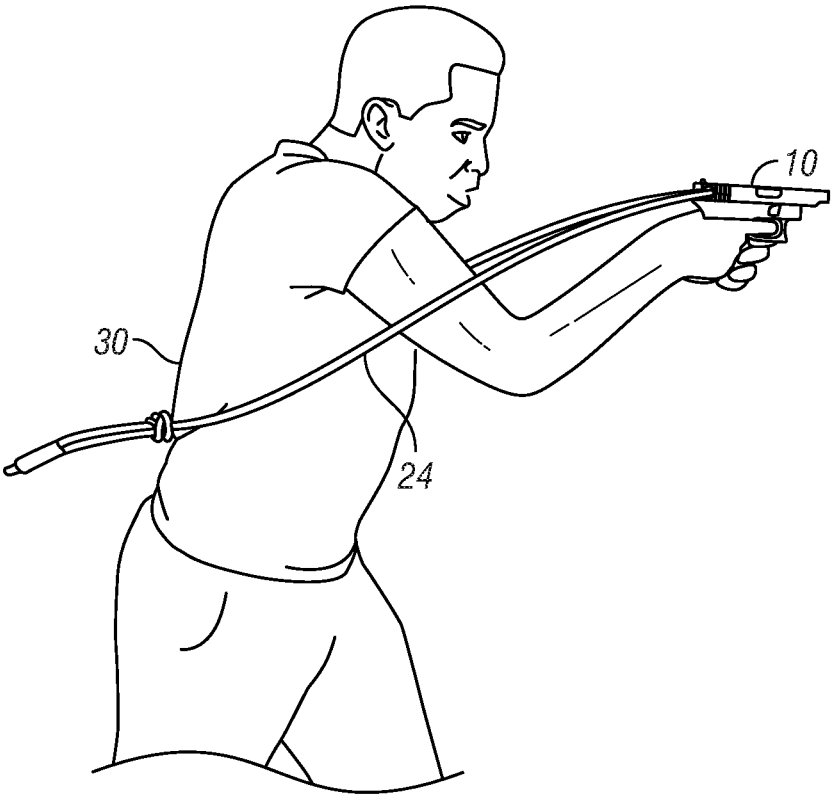
FIG. 4 is a side view similar to FIG. 4 of a person using a firearm training device in accordance with the present inventions to perform an exercise to strengthen the person's ability to grip and maintain control of a firearm.

Referring now to FIG. 3, the training device 10 is shown in use by a user 30. The stretchable loop cord 24 is shown wrapped or positioned around the torso of the user 30. The user 30 is shown gripping the training device 10 in a customary manner of holding a hand gun. In FIG. 3, the user 30 is shown with the user's arms fully extended away from the user's torso, and against the resistance of the stretchable loop cord 24. With reference to FIG. 4, the user 30 is shown with the user's arms bent and pulled in toward the user's torso in a resting or starting position, in which the stretchable cord 24 is loosely hanging around the user's torso.

In a specific embodiment, an example exercise that can be performed with the device 10 is for the user 30 to move between the starting or resting position shown in FIG. 4, and the arms-extended or engaged position as shown in FIG. 3. In a specific embodiment, the user 30 could perform three sets of ten repetitions of this exercise. Performing an exercise such as this will exercise the user's 30 muscles to strengthen the user's 30 ability to grip a handgun. This exercise is beneficial to anyone desiring to develop a greater ability to hold on to a firearm in any variety of situations, such as by law enforcement officers and military soldiers during hand to hand combat, for example. Others who may benefit from this exercise include homeowners desiring to develop a greater ability to grip a handgun during an altercation with a criminal entering the homeowner's home, such as a home invasion.

Figure 5:
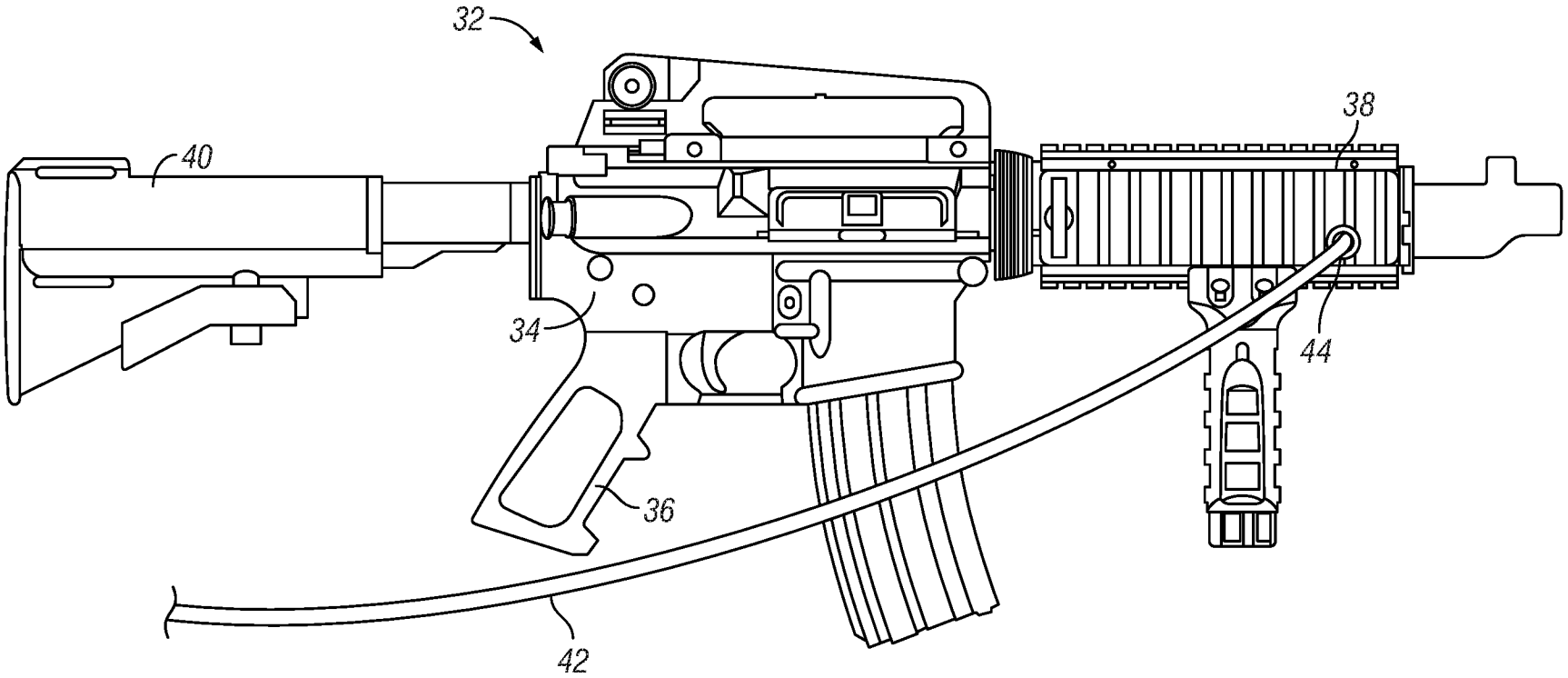
FIG. 5 is a perspective view showing a specific embodiment of a firearm training device in the form of a rifle constructed in accordance with one aspect of the present inventions.

FIG. 5 shows another embodiment of a firearm training device 32 in the shape of a rifle such as an AR-15. The device 32 may include a body member 34 having a grip or handle 36 and a muzzle end 38 and a butt stock end 40. The device 32 may include a stretchable exercise band 42 connected to the muzzle end 38 of the body member 34 through a transverse aperture 44 in the muzzle end 38. This rifle embodiment of a training device 32 may be used in the same way as describe above and in FIGS. 3 and 4 for the hand gun embodiment.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims. None of the claim language should be interpreted pursuant to 35 U.S.C. 112(f) unless the word "means" is recited in any of the claim language, and then only with respect to any recited "means" limitation.

The invention claimed is:

1. A firearm training device comprising:

a body member having a barrel section and a grip;

the barrel section having a muzzle end and a rear end;

the barrel section having a transverse aperture in the rear end of the barrel section; and a stretchable loop member disposed through the transverse aperture and connected to the body member, the stretchable loop member forming a closed loop having sufficient length to be positioned around the torso of a user.

2. The firearm training device of claim 1, wherein the body member is in the shape of a hand gun.

3. A firearm training device comprising:

a body member having a grip, a muzzle end and a butt stock end;

the body member having a transverse aperture in the muzzle end of the body member; and a stretchable loop member disposed through the transverse aperture and connected to the body member, the stretchable loop member forming a closed loop having sufficient length to be positioned around the torso of a user.

4. The firearm training device of claim 3, wherein the body member is in the shape of a rifle.

5. A method of performing an exercise to strengthen the ability of a person to grip a firearm comprising:

using a firearm training device to perform an exercise, the firearm training device comprising a body member having a barrel section and a grip, and a stretchable loop exercise band connected to the body member through a transverse aperture in a rear end of the barrel section of the body member;

positioning the stretchable loop exercise band around a person's torso;

the person gripping the grip of the firearm training device with at least one hand; and the person using the firearm training device to perform an exercise.

6. The method of claim 5, wherein the body member is in the shape of one of a hand gun and a rifle.

7. The method of claim 5, wherein the person moves the firearm training device from a first position in which the person's arms are bent with elbows adjacent the person's torso and the stretchable loop exercise band is in a slack position, to a second position in which the person's arms are straight and held away from the person's torso with the stretchable loop exercise band in a stretched position.

* * * * *